US012123078B2

(12) United States Patent
Lin et al.

(10) Patent No.: US 12,123,078 B2
(45) Date of Patent: Oct. 22, 2024

(54) ALUMINUM-MAGNESIUM-ZINC ALUMINUM ALLOYS

(71) Applicant: HOWMET AEROSPACE INC., Pittsburgh, PA (US)

(72) Inventors: Jen C. Lin, Export, PA (US); Wei Wen, Allison Park, PA (US); Santosh Prasad, Murrysville, PA (US); Mark D. Crowley, Pittsburgh, PA (US); Gabriele F. Ciccola, Hudson, OH (US); Matthew C. Brest, Hudson, OH (US)

(73) Assignee: Howmet Aerospace Inc., Pittsburgh, PA (US)

( * ) Notice: Subject to any disclaimer, the term of this patent is extended or adjusted under 35 U.S.C. 154(b) by 594 days.

(21) Appl. No.: 17/400,429

(22) Filed: Aug. 12, 2021

(65) Prior Publication Data

US 2022/0098707 A1 Mar. 31, 2022

Related U.S. Application Data

(63) Continuation of application No. PCT/US2020/018167, filed on Feb. 13, 2020.

(60) Provisional application No. 62/808,136, filed on Feb. 20, 2019.

(51) Int. Cl.

| | |
|---|---|
| ***C22C 21/08*** | (2006.01) |
| ***B22D 21/00*** | (2006.01) |
| ***B22F 3/24*** | (2006.01) |
| ***C22F 1/047*** | (2006.01) |

(52) U.S. Cl.

CPC ..... *C22C 21/08* (2013.01); *B22D 21/007* (2013.01); *B22F 3/24* (2013.01); *C22F 1/047* (2013.01); *B22F 2003/242* (2013.01)

(58) Field of Classification Search

CPC ..... C22C 21/08; C22C 21/06; C22C 21/10; C22F 1/047; C22F 1/053

See application file for complete search history.

(56) References Cited

U.S. PATENT DOCUMENTS

| | | | |
|---|---|---|---|
| 2,823,994 | A | 2/1958 | Rosenkranz et al. |
| 3,843,357 | A | 10/1974 | Nimi et al. |
| 3,881,966 | A | 5/1975 | Staley et al. |
| 4,840,685 | A | 6/1989 | Nabae |
| 5,759,302 | A | 6/1998 | Nakai et al. |
| 6,132,531 | A | 10/2000 | Fang et al. |
| 6,440,290 | B1 | 8/2002 | Vega et al. |
| 6,453,712 | B1 | 9/2002 | Klosterman et al. |
| 6,733,566 | B1 | 5/2004 | Fang et al. |
| 6,773,666 | B2 | 8/2004 | Lin et al. |
| 6,783,730 | B2 | 8/2004 | Lin et al. |
| 7,087,125 | B2 | 8/2006 | Lin et al. |
| 7,449,073 | B2 | 11/2008 | Lin et al. |
| 7,452,402 | B2 | 11/2008 | Bryant et al. |
| 8,157,932 | B2 | 4/2012 | Yan et al. |
| 8,287,668 | B2 | 10/2012 | Lin et al. |
| 8,349,462 | B2 | 1/2013 | Lin et al. |
| 8,840,737 | B2 | 9/2014 | Bray et al. |
| 8,845,827 | B2 | 9/2014 | Yanar et al. |
| 9,194,028 | B2 | 11/2015 | Kamat et al. |
| 9,249,484 | B2 | 2/2016 | Kamat et al. |
| 9,249,487 | B2 | 2/2016 | Yan et al. |
| 9,315,885 | B2 | 4/2016 | Lin |
| 9,359,660 | B2 | 6/2016 | Kamat et al. |
| 9,458,528 | B2 | 10/2016 | Boselli et al. |
| 9,556,502 | B2 | 1/2017 | Lin et al. |
| 9,580,775 | B2 | 2/2017 | Lin |
| 9,587,298 | B2 | 3/2017 | Lin et al. |
| 9,604,498 | B2 | 3/2017 | Zehnder et al. |
| 9,850,552 | B2 | 12/2017 | Monette, Jr. |
| 9,850,556 | B2 | 12/2017 | Lin |
| 9,890,443 | B2 | 2/2018 | Lin et al. |
| 9,926,620 | B2 | 3/2018 | Kamat et al. |
| 10,119,183 | B2 | 11/2018 | Lin et al. |
| 10,161,021 | B2 | 12/2018 | Lin et al. |
| 10,174,409 | B2 | 1/2019 | Yan et al. |
| 10,202,673 | B2 | 2/2019 | Lin et al. |
| 10,227,679 | B2 | 3/2019 | Yan et al. |
| 10,494,702 | B2 | 12/2019 | Kim et al. |
| 10,590,515 | B2 | 3/2020 | Lin et al. |
| 11,103,919 | B2 | 8/2021 | Yan et al. |
| 2004/0079198 | A1 | 4/2004 | Bryant et al. |
| 2004/0163492 | A1 | 8/2004 | Crowley et al. |
| 2005/0167012 | A1 | 8/2005 | Lin et al. |
| 2005/0238528 | A1 | 10/2005 | Lin et al. |
| 2006/0016523 | A1 | 1/2006 | Dif et al. |
| 2006/0032560 | A1 | 2/2006 | Benedictus et al. |
| 2006/0243095 | A1 | 11/2006 | Bryant et al. |
| 2006/0289093 | A1 | 12/2006 | Yan et al. |
| 2007/0017604 | A1 | 1/2007 | Yan et al. |
| 2007/0125460 | A1 | 6/2007 | Lin et al. |
| 2008/0066833 | A1 | 3/2008 | Lin et al. |
| 2010/0037998 | A1 | 2/2010 | Bray et al. |
| 2010/0047113 | A1 | 2/2010 | Lin et al. |
| 2010/0129683 | A1 | 5/2010 | Lin et al. |

(Continued)

FOREIGN PATENT DOCUMENTS

| | | |
|---|---|---|
| CN | 101590591 | 12/2009 |
| EP | 2263811 | 12/2010 |

(Continued)

OTHER PUBLICATIONS

ANSI H35.1 (2009).

(Continued)

*Primary Examiner* — Jessee R Roe

(74) *Attorney, Agent, or Firm* — Greenberg Traurig, LLP

(57) ABSTRACT

New aluminum alloys having magnesium and zinc are disclosed. The new magnesium-zinc aluminum alloys may include from 2.5 to 4.0 wt. % Mg, from 2.25 to 4.0 wt. % Zn, wherein (wt. % Mg/wt. % Zn)≥1.0, and wherein (wt. % Mg/wt. % Zn)≤1.6, from 0.20 to 0.9 wt. % Mn, from 0.10 to 0.40 wt. % Cu, up to 1.0 wt. % Li, up to 0.50 wt. % Fe, up to 0.50 wt. % Si, and optional secondary element(s), the balance being aluminum, optional incidental elements and impurities.

13 Claims, No Drawings

(56) References Cited

U.S. PATENT DOCUMENTS

| | | | |
|---|---|---|---|
| 2010/0183869 | A1 | 7/2010 | Lin et al. |
| 2010/0276108 | A1 | 11/2010 | Stol et al. |
| 2010/0319817 | A1 | 12/2010 | Norman et al. |
| 2012/0055590 | A1 | 3/2012 | Kamat et al. |
| 2013/0015287 | A1 | 1/2013 | Bryant et al. |
| 2014/0230974 | A1 | 8/2014 | Lin et al. |
| 2014/0366997 | A1 | 12/2014 | Kamat et al. |
| 2014/0366998 | A1 | 12/2014 | Kamat et al. |
| 2014/0367000 | A1 | 12/2014 | Kamat et al. |
| 2015/0020930 | A1 | 1/2015 | Kamat et al. |
| 2015/0284825 | A1 | 10/2015 | Norman et al. |
| 2016/0107265 | A1 | 4/2016 | Lin et al. |
| 2017/0088920 | A1 | 3/2017 | Boselli et al. |
| 2017/0120386 | A1 | 5/2017 | Lin et al. |
| 2017/0120393 | A1 | 5/2017 | Lin et al. |
| 2017/0121795 | A1 | 5/2017 | Yan et al. |
| 2017/0175239 | A1 | 6/2017 | Ahmed et al. |
| 2017/0175240 | A1 | 6/2017 | Wen et al. |
| 2017/0222108 | A1 | 8/2017 | Chang et al. |
| 2017/0292174 | A1 | 10/2017 | Karabin et al. |
| 2017/0306447 | A1 | 10/2017 | Lin et al. |
| 2017/0306448 | A1 | 10/2017 | Lin et al. |
| 2017/0306449 | A1 | 10/2017 | Lin et al. |
| 2017/0306450 | A1 | 10/2017 | Lin et al. |
| 2017/0306457 | A1 | 10/2017 | Lin et al. |
| 2017/0306460 | A1 | 10/2017 | Lin et al. |
| 2017/0314112 | A1 | 11/2017 | Go et al. |
| 2017/0326690 | A1 | 11/2017 | Heard et al. |
| 2017/0369978 | A1 | 12/2017 | Kang et al. |
| 2018/0171438 | A1 | 6/2018 | Yan et al. |
| 2018/0274063 | A1 | 9/2018 | Wen et al. |
| 2019/0010591 | A1 | 1/2019 | Das et al. |
| 2019/0284866 | A1 | 9/2019 | Marinack, Jr. et al. |
| 2019/0309402 | A1 | 10/2019 | Karabin et al. |
| 2019/0357647 | A1 | 11/2019 | Kilmer et al. |
| 2019/0360082 | A1 | 11/2019 | Ahmed et al. |
| 2019/0376165 | A1 | 12/2019 | Wen et al. |
| 2020/0056268 | A1 | 2/2020 | Heard et al. |
| 2020/0080182 | A1 | 3/2020 | Ahmed et al. |
| 2020/0095664 | A1 | 3/2020 | Wen et al. |
| 2020/0115780 | A1 | 4/2020 | Boselli et al. |
| 2020/0189314 | A1 | 6/2020 | Zehnder et al. |
| 2020/0262237 | A1 | 8/2020 | Sklyut et al. |
| 2020/0277691 | A1 | 9/2020 | Lin et al. |
| 2021/0404038 | A1 | 12/2021 | Boselli et al. |

FOREIGN PATENT DOCUMENTS

| | | |
|---|---|---|
| GB | 1388296 | 3/1975 |
| JP | 52-9602 | 3/1977 |
| JP | 03-41540 | 6/1991 |
| JP | 08-325664 | 12/1996 |
| JP | 10-168536 | 6/1998 |
| JP | 2006-152403 | 6/2006 |
| JP | 2011-038136 | 2/2011 |
| JP | 2012-097337 | 5/2012 |
| JP | 2012-143798 | 8/2012 |
| SU | 666897 | 1/1981 |
| WO | WO2013/133960 | 9/2013 |
| WO | WO2018/157159 | 8/2018 |
| WO | WO2019/055623 | 3/2019 |
| WO | WO2019/055630 | 3/2019 |
| WO | WO2019/084045 | 5/2019 |
| WO | WO2019/099719 | 5/2019 |
| WO | WO2019/161137 | 8/2019 |

OTHER PUBLICATIONS

International Search Report and Written Opinion, dated Jun. 12, 2020, from corresponding International Patent App. No. PCT/US2020/018167.

ALUMINUM-MAGNESIUM-ZINC ALUMINUM ALLOYS

CROSS-REFERENCE TO RELATED APPLICATION

This application is a continuation of International Patent Application No. PCT/US2020/018167, filed Feb. 13, 2020, which claims benefit of priority of U.S. Patent Application No. 62/808,136, filed Feb. 20, 2019, entitled "IMPROVED ALUMINUM-MAGNESIUM-ZINC ALUMINUM ALLOYS", each of which is incorporated herein by reference in its entirety.

FIELD OF THE INVENTION

The present patent application relates to improved aluminum alloys having magnesium and zinc ("magnesium-zinc aluminum alloys") and products made from the same.

BACKGROUND

Aluminum alloys are useful in a variety of applications. However, improving one property of an aluminum alloy without degrading another property is elusive. For example, it is difficult to increase the strength of an alloy without decreasing the toughness of an alloy. Other properties of interest for aluminum alloys include corrosion resistance and fatigue crack growth resistance, to name two.

Commonly-owned U.S. Pat. No. 9,315,885 discloses aluminum alloys having magnesium and zinc. However, the '885 patent does not disclose, for instance, how to achieve good mechanical properties in combination with good surface appearance properties. Further, the '885 patent does not disclose fatigue properties.

SUMMARY OF THE DISCLOSURE

Broadly, the present patent application relates to improved heat treatable aluminum alloys having magnesium and zinc ("magnesium-zinc aluminum alloys"), and methods of producing the same. For purposes of the present application, magnesium-zinc aluminum alloys are aluminum alloys having 2.5-4.0 wt. % magnesium and 2.25-4.0 wt. % zinc, and where the weight ratio of magnesium-to-zinc in the alloy is from 1.0-1.6, i.e., 1.0≤(wt. % Mg/wt. % Zn)≤1.6. The new magnesium-zinc aluminum alloys also generally include manganese and copper, and may include lithium, silicon, iron, and secondary elements, as defined below. The balance of the magnesium-zinc aluminum alloys generally comprises aluminum, optional incidental elements and impurities. The new magnesium-zinc aluminum alloys generally realize an improved combination of at least two of strength, ductility, fatigue life, corrosion resistance, surface appearance (color, gloss), surface hardness and thermal stability, among others.

i. Composition

In one approach, a new magnesium-zinc aluminum alloy includes from 2.5 to 4.0 wt. % Mg, from 2.25 to 4.0 wt. % Zn, wherein (wt. % Mg/wt. % Zn)≥1.0, and wherein (wt. % Mg/wt. % Zn)≤1.6, from 0.20 to 0.9 wt. % Mn, from 0.10 to 0.40 wt. % Cu, up to 1.0 wt. % Li, up to 0.50 wt. % Fe, up to 0.50 wt. % Si, optionally at least one secondary element selected from the group consisting of Zr, Sc, Cr, Hf, V, Ti, and rare earth elements, and in the following amounts:

up to 0.20 wt. % Zr, up to 0.30 wt. % Sc, up to 0.50 wt. % Cr, up to 0.25 wt. % each of any of Hf, V, and rare earth elements, and up to 0.25 wt. % Ti, the balance being aluminum, optional incidental elements and impurities.

As noted above, a new magnesium-zinc aluminum alloy generally includes from 2.5 to 4.0 wt. % Mg. In one embodiment, a new magnesium-zinc aluminum alloy includes at least 2.75 wt. % Mg. In another embodiment, a new magnesium-zinc aluminum alloy includes at least 3.0 wt. % Mg. In one embodiment, a new magnesium-zinc aluminum alloy includes not greater than 3.75 wt. % Mg. In another embodiment, a new magnesium-zinc aluminum alloy includes not greater than 3.5 wt. % Mg.

As noted above, a new magnesium-zinc aluminum alloy generally includes from 2.25 to 4.0 wt. % Zn. In one embodiment, a new magnesium-zinc aluminum alloy includes at least 2.5 wt. % Zn. In another embodiment, a new magnesium-zinc aluminum alloy includes at least 2.75 wt. % Zn. In one embodiment, a new magnesium-zinc aluminum alloy includes not greater than 3.75 wt. % Zn. In another embodiment, a new magnesium-zinc aluminum alloy includes not greater than 3.5 wt. % Zn. In yet another embodiment, a new magnesium-zinc aluminum alloy includes not greater than 3.25 wt. % Zn. In another embodiment, a new magnesium-zinc aluminum alloy includes not greater than 3.0 wt. % Zn.

As noted above, a new magnesium-zinc aluminum alloy may include from 0.10 to 0.40 wt. % Cu. In one embodiment, a new magnesium-zinc aluminum alloy includes not greater than 0.35 wt. % Cu. In another embodiment, a new magnesium-zinc aluminum alloy includes not greater than 0.30 wt. % Cu. In one embodiment, a new magnesium-zinc aluminum alloy includes at least 0.12 wt. % Cu. In another embodiment, a new magnesium-zinc aluminum alloy includes at least 0.15 wt. % Cu.

As noted above, a new magnesium-zinc aluminum alloy may include from 0.20 to 0.9 wt. % Mn. In one embodiment, a new magnesium-zinc aluminum alloy includes at least 0.25 wt. % Mn. In another embodiment, a new magnesium-zinc aluminum alloy includes at least 0.30 wt. % Mn. In yet another embodiment, a new magnesium-zinc aluminum alloy includes at least 0.35 wt. % Mn. In another embodiment, a new magnesium-zinc aluminum alloy includes at least 0.40 wt. % Mn. In one embodiment, a new magnesium-zinc aluminum alloy includes not greater than 0.80 wt. % Mn. In another embodiment, a new magnesium-zinc aluminum alloy includes not greater than 0.75 wt. % Mn. In yet another embodiment, a new magnesium-zinc aluminum alloy includes not greater than 0.65 wt. % Mn. In another embodiment, a new magnesium-zinc aluminum alloy includes not greater than 0.60 wt. % Mn.

As noted above, a new magnesium-zinc aluminum alloy may include up to 1.0 wt. % Li. In embodiments where Li is included, a new magnesium-zinc aluminum alloy generally includes at least 0.02 wt. % Li. In embodiments where Li is excluded, a new magnesium-zinc aluminum alloy generally includes not greater than 0.01 wt. % Li. In one embodiment, a new magnesium-zinc aluminum alloy includes not greater than 0.005 wt. % Li.

As noted above, a new magnesium-zinc aluminum alloy may include up to 0.50 wt. % Fe. In one embodiment, a new magnesium-zinc aluminum alloy includes at least 0.01 wt. % Fe. In one embodiment, a new magnesium-zinc aluminum alloy includes not greater than about 0.40 wt. % Fe. In another embodiment, a new magnesium-zinc aluminum alloy includes not greater than about 0.30 wt. % Fe. In yet another embodiment, a new magnesium-zinc aluminum alloy includes not greater than about 0.25 wt. % Fe. In another embodiment, a new magnesium-zinc aluminum alloy includes not greater than about 0.20 wt. % Fe.

As noted above, a new magnesium-zinc aluminum alloy may include up to 0.50 wt. % Si. In one embodiment, a new magnesium-zinc aluminum alloy includes at least 0.01 wt. % Si. In one embodiment, a new magnesium-zinc aluminum alloy includes not greater than 0.40 wt. % Si. In another embodiment, a new magnesium-zinc aluminum alloy includes not greater than 0.30 wt. % Si. In yet another embodiment, a new magnesium-zinc aluminum alloy includes not greater than 0.25 wt. % Si. In another embodiment, a new magnesium-zinc aluminum alloy includes not greater than 0.20 wt. % Si.

The new magnesium-zinc aluminum alloys may include at least one secondary element selected from the group consisting of Zr, Sc, Cr, Hf, V, Ti, and rare earth elements. Such elements may be used, for instance, to facilitate the appropriate grain structure in a resultant magnesium-zinc aluminum alloy product. The secondary elements may optionally be present as follows: up to 0.20 wt. % Zr, up to 0.30 wt. % Sc, up to 0.50 wt. % of Cr, up to 0.25 wt. % each of any of Hf, V, Ti, and rare earth elements. However, the total content of the secondary elements should be controlled/tailored such that large primary particles (e.g., primary particles so large they degrade alloy properties) are avoided/restricted in the aluminum alloy product. In some instances, zirconium (Zr) and/or scandium (Sc) may be preferred for grain structure control. When zirconium is used, it is generally included in the new magnesium-zinc aluminum alloys at 0.05 to 0.20 wt. % Zr. In one embodiment, a new magnesium-zinc aluminum alloy includes 0.07 to 0.16 wt. % Zr. Scandium may be used in addition to, or as a substitute for zirconium, and, when present, is generally included in the new magnesium-zinc aluminum alloys at 0.05 to 0.30 wt. % Sc. In one embodiment, a new magnesium-zinc aluminum alloy includes 0.07 to 0.25 wt. % Sc. Chromium (Cr) may also be used in addition to, or as a substitute for, zirconium and/or scandium, and when present is generally included in the new magnesium-zinc aluminum alloys at 0.05 to 0.50 wt. % Cr. In one embodiment, a new magnesium-zinc aluminum alloy includes 0.05 to 0.35 wt. % Cr. In another embodiment, a new magnesium-zinc aluminum alloy includes 0.05 to 0.25 wt. % Cr. In other embodiments, any of zirconium, scandium, and/or chromium may be included in the alloy as an impurity, and in these embodiments such elements would be included in the alloy at less than 0.05 wt. %.

Hf, V and rare earth elements may be included an in an amount of up to 0.25 wt. % each (i.e., up to 0.25 wt. % each of any of Hf and V and up to 0.25 wt. % each of any rare earth element may be included). In one embodiment, a new magnesium-zinc aluminum alloy includes not greater than 0.05 wt. % each of Hf, V, and rare earth elements (not greater than 0.05 wt. % each of any of Hf and V and not greater than 0.05 wt. % each of any rare earth element may be included).

In some embodiments, titanium is preferred for grain refining, and may be included in the new magnesium-zinc aluminum alloys at any suitable amount, such as up to 0.25 wt. % Ti. The amount of titanium in the alloy should be restricted such that large primary particles are avoided/restricted/limited during production of alloy products. In one embodiment, a new magnesium-zinc aluminum alloy includes at least 0.005 wt. % Ti. In another embodiment, a new magnesium-zinc aluminum alloy includes at least 0.01 wt. % Ti. In yet another embodiment, a new magnesium-zinc aluminum alloy includes at least 0.02 wt. % Ti. In one embodiment, a new a new magnesium-zinc aluminum alloy includes not greater than 0.20 wt. % Ti. In another embodiment, a new a new magnesium-zinc aluminum alloy includes not greater than 0.15 wt. % Ti. In yet another embodiment, a new a new magnesium-zinc aluminum alloy includes not greater than 0.10 wt. % Ti. In another embodiment, a new a new magnesium-zinc aluminum alloy includes not greater than 0.08 wt. % Ti. In yet another embodiment, a new a new magnesium-zinc aluminum alloy includes not greater than 0.05 wt. % Ti. In another embodiment, a new a new magnesium-zinc aluminum alloy includes not greater than 0.03 wt. % Ti. In one embodiment, a new a new magnesium-zinc aluminum alloy includes from 0.005 to 0.10 wt. % Ti. In another embodiment, a new magnesium-zinc aluminum alloy includes from 0.01 to 0.05 wt. % Ti. In yet another embodiment, a new magnesium-zinc aluminum alloy includes from 0.01 to 0.03 wt. % Ti.

As noted above, the new magnesium-zinc aluminum alloys generally include the stated alloying ingredients, the balance being aluminum, optional incidental elements, and impurities. As used herein, "incidental elements" means those elements or materials, other than the above listed elements, that may optionally be added to the alloy to assist in the production of the alloy. Examples of incidental elements include casting aids, such as grain refiners and deoxidizers. Optional incidental elements may be included in the alloy in a cumulative amount of up to 1.0 wt. %. As one non-limiting example, one or more incidental elements may be added to the alloy during casting to reduce or restrict (and is some instances eliminate) ingot cracking due to, for example, oxide fold, pit and oxide patches. These types of incidental elements are generally referred to herein as deoxidizers. Examples of some deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of about 0.001-0.03 wt % or about 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm. Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

The new magnesium-zinc aluminum alloys may contain low amounts of impurities. In one embodiment, a new magnesium-zinc aluminum alloy includes not greater than 0.15 wt. %, in total, of the impurities, and wherein the magnesium-zinc aluminum alloy includes not greater than 0.05 wt. % of each of the impurities. In another embodiment, a new magnesium-zinc aluminum alloy includes not greater than 0.10 wt. %, in total, of the impurities, and wherein the magnesium-zinc aluminum alloy includes not greater than 0.03 wt. % of each of the impurities.

ii. Processing

The new magnesium-zinc aluminum alloys may be useful in a variety of product forms, including ingot or billet, wrought product forms (plate, forgings and extrusions), shape castings, additively manufactured products, and powder metallurgy products, for instance. For instance, the new magnesium-zinc aluminum alloys may be processed into a variety of wrought forms, such as in rolled form (sheet, plate), as an extrusion, or as a forging, and in a variety of tempers. In this regard, the new magnesium-zinc aluminum alloys may be cast (e.g., direct chill cast or continuously cast), and then worked (hot and/or cold worked) into the appropriate product form (sheet, plate, extrusion, or forging). After working, the new magnesium-zinc aluminum alloys may be processed to one of a T temper, a W temper, or an F temper as per ANSI H35.1 (2009). In one embodiment, a new magnesium-zinc aluminum alloy is processed to a "T temper" (thermally treated). In this regard, the new magnesium-zinc aluminum alloys may be processed to any of a T1, T2, T3, T4, T5, T6, T7, T8, T9 or T10 temper as per ANSI H35.1 (2009). Multiple tempers may be achieved in a single product. For instance, and as described below, a wheel may be forged and then air cooled, resulting in a press-quenched state, after which the wheel may be cold spun. The cold spinning may result in some portions of the wheel receiving cold work and with other portions of the wheel receiving no or insubstantial cold work. After artificial aging, the cold worked portions of such a wheel may be in a T10 temper, whereas the other portions of the wheel may be in a T5 temper. In other embodiments, a new magnesium-zinc aluminum alloy is processed to an "W temper" (solution heat treated). In another embodiment, no solution heat treatment is applied after working the aluminum alloy into the appropriate product form, and thus the new magnesium-zinc aluminum alloys may be processed to an "F temper" (as fabricated).

In one embodiment, a new magnesium-zinc aluminum alloys is a forged wheel product (e.g., a die forged wheel product). In one embodiment, the forged wheel product is processed to a T5 temper, a T10 temper, or both where some portions of the product are in the T5 temper and other portions of the product are in the T10 temper (as described above and below).

iii. Properties

In one embodiment, a new magnesium-zinc aluminum alloy realizes a tensile yield strength (TYS) of at least 32 ksi. In one embodiment, a new magnesium-zinc aluminum alloy realizes a tensile yield strength (TYS) of from 32 to 48 ksi. In another embodiment, a new magnesium-zinc aluminum alloy realizes a tensile yield strength (TYS) of from 40 to 48 ksi. In one embodiment, a new magnesium-zinc aluminum alloy realizes a tensile yield strength (TYS) of at least 33 ksi. In another embodiment, a new magnesium-zinc aluminum alloy realizes a tensile yield strength (TYS) of at least 34 ksi. In yet another embodiment, a new magnesium-zinc aluminum alloy realizes a tensile yield strength (TYS) of at least 35 ksi. In another embodiment, a new magnesium-zinc aluminum alloy realizes a tensile yield strength (TYS) of at least 36 ksi. In yet another embodiment, a new magnesium-zinc aluminum alloy realizes a tensile yield strength (TYS) of at least 37 ksi. In another embodiment, a new magnesium-zinc aluminum alloy realizes a tensile yield strength (TYS) of at least 38 ksi. In yet another embodiment, a new magnesium-zinc aluminum alloy realizes a tensile yield strength (TYS) of at least 39 ksi. In another embodiment, a new magnesium-zinc aluminum alloy realizes a tensile yield strength (TYS) of at least 40 ksi. In another embodiment, a new magnesium-zinc aluminum alloy realizes a tensile yield strength (TYS) of at least 41 ksi. In another embodiment, a new magnesium-zinc aluminum alloy realizes a tensile yield strength (TYS) of at least 42 ksi. In yet another embodiment, a new magnesium-zinc aluminum alloy realizes a tensile yield strength (TYS) of at least 43 ksi. In another embodiment, a new magnesium-zinc aluminum alloy realizes a tensile yield strength (TYS) of at least 44 ksi. In yet another embodiment, a new magnesium-zinc aluminum alloy realizes a tensile yield strength (TYS) of at least 45 ksi. In another embodiment, a new magnesium-zinc aluminum alloy realizes a tensile yield strength (TYS) of at least 46 ksi. In yet another embodiment, a new magnesium-zinc aluminum alloy realizes a tensile yield strength (TYS) of at least 47 ksi.

In one embodiment, a new magnesium-zinc aluminum alloy realizes an ultimate tensile strength (UTS) of at least 45 ksi. In one embodiment, a new magnesium-zinc aluminum alloy realizes an ultimate tensile strength (UTS) of from 45 to 60 ksi. In another embodiment, a new magnesium-zinc aluminum alloy realizes an ultimate tensile strength (UTS) of from 50 to 60 ksi. In one embodiment, a new magnesium-zinc aluminum alloy realizes an ultimate tensile strength (UTS) of at least 46 ksi. In another embodiment, a new magnesium-zinc aluminum alloy realizes an ultimate tensile strength (UTS) of at least 47 ksi. In yet another embodiment, a new magnesium-zinc aluminum alloy realizes an ultimate tensile strength (UTS) of at least 48 ksi. In another embodiment, a new magnesium-zinc aluminum alloy realizes an ultimate tensile strength (UTS) of at least 49 ksi. In yet another embodiment, a new magnesium-zinc aluminum alloy realizes an ultimate tensile strength (UTS) of at least 50 ksi. In another embodiment, a new magnesium-zinc aluminum alloy realizes an ultimate tensile strength (UTS) of at least 51 ksi. In another embodiment, a new magnesium-zinc aluminum alloy realizes an ultimate tensile strength (UTS) of at least 52 ksi. In yet another embodiment, a new magnesium-zinc aluminum alloy realizes an ultimate tensile strength (UTS) of at least 53 ksi. In another embodiment, a new magnesium-zinc aluminum alloy realizes an ultimate tensile strength (UTS) of at least 54 ksi. In yet another embodiment, a new magnesium-zinc aluminum alloy realizes an ultimate tensile strength (UTS) of at least 55 ksi. In another embodiment, a new magnesium-zinc aluminum alloy realizes an ultimate tensile strength (UTS) of at least 56 ksi. In yet another embodiment, a new magnesium-zinc aluminum alloy realizes an ultimate tensile strength (UTS) of at least 57 ksi. In another embodiment, a new magnesium-zinc aluminum alloy realizes an ultimate tensile strength (UTS) of at least 58 ksi. In yet another embodiment, a new magnesium-zinc aluminum alloy realizes an ultimate tensile strength (UTS) of at least 59 ksi.

In one embodiment, a new magnesium-zinc aluminum alloy realizes an elongation of at least 10%. In one embodiment, a new magnesium-zinc aluminum alloy realizes an elongation of from 10% to 20%. In one embodiment, a new magnesium-zinc aluminum alloy realizes an elongation of at least 11%. In another embodiment, a new magnesium-zinc aluminum alloy realizes an elongation of at least 12%. In yet another embodiment, a new magnesium-zinc aluminum alloy realizes an elongation of at least 13%. In another embodiment, a new magnesium-zinc aluminum alloy realizes an elongation of at least 14%. In yet another embodiment, a new magnesium-zinc aluminum alloy realizes an elongation of at least 15%. In another embodiment, a new magnesium-zinc aluminum alloy realizes an elongation of at least 16%. In yet another embodiment, a new magnesium-zinc aluminum alloy realizes an elongation of at least 17%. In another embodiment, a new magnesium-zinc aluminum alloy realizes an elongation of at least 18%. In yet another embodiment, a new magnesium-zinc aluminum alloy realizes an elongation of at least 19%.

In one embodiment, a new magnesium-zinc aluminum alloy realizes a rotating beam fatigue life of at least 1,000,000 cycles when tested in accordance with ISO1143, where the test conditions are R=−1, the stress is 25 ksi, and the testing specimen is unnotched ($K_t$=1). In another embodiment, a new magnesium-zinc aluminum alloy realizes a rotating beam fatigue life of at least 2,000,000 cycles when tested as per above. In another embodiment, a new magnesium-zinc aluminum alloy realizes a rotating beam fatigue life of at least 3,000,000 cycles when tested as per above. In another embodiment, a new magnesium-zinc aluminum alloy realizes a rotating beam fatigue life of at least 4,000,000 cycles when tested as per above.

In one embodiment, a new magnesium-zinc aluminum alloy realizes a rotating beam fatigue life of at least 100,000 cycles when tested in accordance with ISO1143, where the test conditions are R=−1, the stress is 35 ksi, and the testing specimen is unnotched ($K_t$=1).

In one embodiment, a new magnesium-zinc aluminum alloy realizes an average depth of attack of not greater than 100 micrometers when tested in accordance with ASTM G110, where the depth of attack is measured after 24 hours of immersion and at the 3T/4 location of the product (average of at least 5 locations). In another embodiment, a new magnesium-zinc aluminum alloy realizes an average depth of attack of not greater than 75 micrometers when tested as per above. In yet another embodiment, a new magnesium-zinc aluminum alloy realizes an average depth of attack of not greater than 50 micrometers when tested as per above. In another embodiment, a new magnesium-zinc aluminum alloy realizes an average depth of attack of not greater than 40 micrometers when tested as per above. In yet another embodiment, a new magnesium-zinc aluminum alloy realizes an average depth of attack of not greater than 30 micrometers when tested as per above. In one embodiment, the maximum depth of attack of any one test location is not greater than 100 micrometers when tested as per above (at least 5 locations). In another embodiment, the maximum depth of attack is not greater than 90 micrometers when tested as per above. In another embodiment, the maximum depth of attack is not greater than 80 micrometers when tested as per above. In another embodiment, the maximum depth of attack is not greater than 70 micrometers when tested as per above. In another embodiment, the maximum depth of attack is not greater than 60 micrometers when tested as per above. In another embodiment, the maximum depth of attack is not greater than 50 micrometers when tested as per above. In another embodiment, the maximum depth of attack is not greater than 40 micrometers when tested as per above. In another embodiment, the maximum depth of attack is not greater than 30 micrometers when tested as per above. In one embodiment, the corrosion mode is solely pitting, or better, when tested as per above.

In one embodiment, a new magnesium-zinc aluminum alloy product realizes a coated L* color value (after being anodized and coated per U.S. Pat. No. 6,440,290, described below) of not greater than 40 L* when measured in accordance with ASTM E1164/E308, using a BYK Color Calibration Standard number of 1083053 (L*=94.89), and using a hand-held BYK-Gardner Spectro Guide 45/0 Spectrophotometer (or equivalent), and using an average of at least three L* measurements. In one embodiment, a new magnesium-zinc aluminum alloy product realizes a coated L* color value of not greater than 35 L*. In another embodiment, a new magnesium-zinc aluminum alloy product realizes a coated L* color value of not greater than 30 L*. In yet another, a new magnesium-zinc aluminum alloy product realizes a coated L* color value of not greater than 28 L*.

In one embodiment, a new magnesium-zinc aluminum alloy product realizes a coated gloss value (after being anodized and coated per U.S. Pat. No. 6,440,290, described below) of at least 550 when measured in accordance with ASTM D4039/D523 and using a hand-held gloss meter Elcometer 406L (or equivalent), using a BYK Gloss Standard number of 10071035 (93.5), and using an average of at least three gloss value measurements. In one embodiment, a new magnesium-zinc aluminum alloy product realizes a coated gloss value of at least 600. In another embodiment, a new magnesium-zinc aluminum alloy product realizes a coated gloss value of at least 650. In yet another embodiment, a new magnesium-zinc aluminum alloy product realizes a coated gloss value of at least 700. In another embodiment, a new magnesium-zinc aluminum alloy product realizes a coated gloss value of at least 725.

In one embodiment, a new magnesium-zinc aluminum alloy product realizes a coated surface hardness value (after being anodized and coated per U.S. Pat. No. 6,440,290, described below) of at least 7H when tested in accordance with ASTM D3363. In another embodiment, a new magnesium-zinc aluminum alloy product realizes a coated surface hardness value of at least 8H. In yet another embodiment, a new magnesium-zinc aluminum alloy product realizes a coated surface hardness value of at least 9H.

In one embodiment, a new magnesium-zinc aluminum alloy product is anodized and coated as per U.S. Pat. No. 6,440,290, described below, and the coating is thermally stable as per GM standard GM9525P (1988), described below, i.e., there is no peeling of the coated surface.

iv. Definitions

Unless otherwise indicated, the following definitions apply to the present application:

"Wrought aluminum alloy product" means an aluminum alloy product that is hot worked (e.g., hot working an ingot or a billet), and includes rolled products (sheet or plate), forged products, and extruded products.

"Forged aluminum alloy product" means a wrought aluminum alloy product that is either die forged or hand forged.

"Solution heat treating" means exposure of an aluminum alloy to elevated temperature for the purpose of placing solute(s) into solid solution.

"Artificially aging" means exposure of an aluminum alloy to elevated temperature for the purpose of precipitating solute(s). Artificial aging may occur in one or a plurality of steps, which can include varying temperatures and/or exposure times.

Strength and elongation are measured in accordance with ASTM E8 and B557.

Temper designations and meanings (e.g., T5, T10, T6, etc.) are per ANSI H35.1 (2009).

"Additive manufacturing" means "a process of joining materials to make objects from 3D model data, usually layer upon layer, as opposed to subtractive manufacturing methodologies", as defined in ASTM F2792-12a entitled "Standard Terminology for Additively Manufacturing Technologies". Non-limiting examples of additive manufacturing processes useful in producing aluminum alloy products include, for instance, DMLS (direct metal laser sintering), SLM (selective laser melting), SLS (selective laser sintering), and EBM (electron beam melting), among others. Any suitable feedstocks made from the above new magnesium-zinc aluminum alloys may be used, including one or more powders, one or more wires, one or more sheets, and combinations thereof. In some embodiments the additive manufacturing feedstock is comprised of one or more powders comprising the new magnesium-zinc aluminum alloys. Shavings are types of particles. In some embodiments, the additive manufacturing feedstock is comprised of one or more wires comprising the new magnesium-zinc aluminum alloys. A ribbon is a type of wire. In some embodiments, the additive manufacturing feedstock is comprised of one or more sheets comprising the new magnesium-zinc aluminum alloys. Foil is a type of sheet.

These and other aspects, advantages, and novel features of this new technology are set forth in part in the description that follows and will become apparent to those skilled in the art upon examination of the following description and figures, or may be learned by practicing one or more embodiments of the technology provided for by the present disclosure.

The figures constitute a part of this specification and include illustrative embodiments of the present disclosure and illustrate various objects and features thereof. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though they may. Furthermore, the phrases "in another embodiment" and "in some other embodiments" as used herein do not necessarily refer to a different embodiment, although they may. Thus, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references, unless the context clearly dictates otherwise. The meaning of "in" includes "in" and "on", unless the context clearly dictates otherwise.

While a number of embodiments of the present invention have been described, it is understood that these embodiments are illustrative only, and not restrictive, and that many modifications may become apparent to those of ordinary skill in the art. Further still, unless the context clearly requires otherwise, the various steps may be carried out in any desired order, and any applicable steps may be added and/or eliminated.

DETAILED DESCRIPTION

Example 1

Four alloys were cast as industrial size ingots, the compositions of which are provided below.

TABLE 1

Composition of Ex. 1 Alloys (in wt. %)

| Alloy | Si | Mg | Zn | Mg/Zn | Cu | Mn | Cr | Fe | Ti | Note |
|---|---|---|---|---|---|---|---|---|---|---|
| 1 | 0.09 | 3.03 | 2.49 | 1.22 | 0.24 | 0.58 | 0.05 | 0.10 | 0.02 | Invention |
| 2 | 0.09 | 3.48 | 3.03 | 1.15 | 0.16 | 0.40 | — | 0.10 | 0.02 | Invention |
| 3 | 1.08 | 0.6 | 0.51 | 1.18 | 1.17 | 0.14 | 0.18 | 0.10 | 0.02 | Non-Invention |
| 4* | 0.75 | 1.12 | 0.21 | 5.33 | 0.38 | 0.14 | 0.23 | 0.18 | 0.01 | Non-invention |

*Alloy 4 is per commonly-owned U.S. Patent No. 9,556,502.

After casting, the alloys were homogenized and cut into billets for forging. The billets were then die forged into wheels, during which the wheels were slowly cooled while traveling through the manufacturing facility. The forging exit temperature was approximately 740° F. (393° C.) and the quench rate was approximately 100° F. (37.8° C.) per minute, which is a relatively slow quench rate. In other words, the wheels were subjected to press-quenching. After the slow cooling, portions of the wheels were cold spun to make the final wheel products. The wheels were then artificial aged by heating to 385° F. (196.1° C.) and then holding for 2 hours at this temperature. Portions of the wheel receiving zero or insubstantial cold work (e.g., the disk face, the mounting flange, the cat ear) are accordingly in the T5 temper after the artificial aging. The portions of the wheel receiving cold work resulting in a change in mechanical properties (e.g., the rim) are in the T10 temper after the artificial aging. ANSI H35.1 (2009) defines these tempers, as per below.

T5: *cooled from an elevated temperature shaping process and then artificially aged.* Applies to products that are not cold worked after cooling from an elevated temperature shaping process, or in which the effect of cold work in flattening or straightening may not be recognized in mechanical property limits.

T10: *cooled from an elevated temperature shaping process, cold worked, and then artificially aged.* artificially aged. Applies to products that are cold worked to improve strength, or in which the effect of cold work in flattening or straightening may not be recognized in mechanical property limits.

Note: different wheels have different geometries, so which portion(s) of a press-quenched wheel (if any) are in the T5 temper and/or the T10 temper should be determined on a case-by-case basis.

Note: in aluminum working terms, "hot" and "cold" have more technical definitions than their common meaning. "Hot" working generally refers to working at a metal temperature high enough to avoid strain-hardening (work-hardening) as the metal is deformed. "Cold" working generally means working the metal at a temperature low enough for strain hardening to occur, even if the alloy would feel hot to human senses."

Mechanical properties of the wheels were measured at various locations, the results of which are provided in Tables 2a-2b, below.

TABLE 2a

Mechanical Properties of Ex. 1 Wheel Products

| | Location of the wheel (Test Direction) | | | | | |
|---|---|---|---|---|---|---|
| | Cat Ear (LT) | | | Disk Face (L) | | |
| Alloy | TYS, ksi | UTS, ksi | Elong, % | TYS, ksi | UTS, ksi | Elong, % |
| 1 | 33.6 | 52.0 | 18.8 | 33.0 | 51.3 | 18.7 |
| 2 | 47.6 | 61.7 | 17.3 | 45.4 | 59.7 | 18.7 |
| 3 | 31.7 | 43.4 | 17.3 | 29.9 | 41.8 | 17.7 |
| 4 | 25.2 | 35.0 | 18.0 | 21.6 | 32.1 | 19.0 |

TABLE 2b

Mechanical Properties of Ex. 1 Wheel Products

| | Location of the wheel (Test Direction) | | | | | |
|---|---|---|---|---|---|---|
| | Mount Face (L) | | | Rim (L) | | |
| Alloy | TYS, ksi | UTS, ksi | Elong, % | TYS, ksi | UTS, ksi | Elong, % |
| 1 | 32.6 | 50.8 | 19.0 | 45.2 | 55.0 | 16.0 |
| 2 | 44.7 | 59.1 | 18.0 | 46.4 | 56.8 | 16.5 |
| 3 | 29.4 | 41.3 | 18.0 | 36.5 | 40.7 | 15.2 |
| 4 | 21.8 | 32.4 | 19.0 | 37.6 | 40.7 | 15.5 |

As shown, despite the slow quench, the invention alloys realized high strength, and with invention alloy 2 realizing extremely high strength.

The fatigue properties of the alloys were also tested by subjecting the wheels to rotating beam fatigue testing in accordance with ISO1143. The R value for the fatigue testing was R=−1, the specimen was unnotched ($K_t$=1), and the stress was an alternating stress with a max stress of 25 ksi. The fatigue specimens were extracted from the disk face location of the wheels. The fatigue results are provided in Table 3, below.

TABLE 3

Fatigue Properties of Ex. 1 Wheel Products

| Alloy | Cycles to Failure (Sample 1) | Cycles to Failure (Sample 1) | Cycles to Failure (Sample 1) | Average |
|---|---|---|---|---|
| 1 | 1.71E+06 | 2.11E+06 | 2.38E+06 | 2,066,667 |
| 2 | 5.00+E6 | 4.05E+06 | 4.95E+06 | 4,500,000 |

TABLE 3-continued

Fatigue Properties of Ex. 1 Wheel Products

| Alloy | Cycles to Failure (Sample 1) | Cycles to Failure (Sample 1) | Cycles to Failure (Sample 1) | Average |
|---|---|---|---|---|
| 3 | 6.52E+05 | 1.50E+06 | 3.09E+05 | 820,333 |
| 4 | 1.22E+05 | 9.95E+04 | 1.15E+05 | 112,166 |

As shown, the invention alloys realized much better fatigue life as compared to the non-invention alloys. Indeed, alloy 2 did not fail even after 4 million cycles of testing.

The corrosion resistance properties of the alloys were also tested in accordance with ASTM G110. The results are provided in Table 4, below. As shown, the invention alloys realize good corrosion resistance properties.

TABLE 4

G110 Corrosion Properties of Alloys

| | G110- Depth of Attack - 24 hours (micrometers) | | | | |
|---|---|---|---|---|---|
| Alloy | 3T/4 (ave.) | 3T/4 (max.) | T/4 (ave.) | T/4 (max.) | Corrosion mode |
| 1 | 18.9 | 24.1 | 17.8 | 40.0 | Pit |
| 2 | 13.9 | 18.2 | 12.0 | 13.1 | Pit |
| 3 | 91.4 | 138.8 | 79.0 | 92.2 | Pit, IGC, ISGC |
| 4 | 96.5 | 140.5 | 78.8 | 100.8 | Pit, IGC, ISGC |

Example 2—Testing of Surface Appearance

Example alloys 2 and 4 were tested for surface appearance properties. Specifically, wheels made from alloys 2 and 4 were phosphoric acid anodized and then coated with a siloxane based polymer in accordance with the conditions set forth in U.S. Pat. No. 6,440,290, i.e. as per Main Steps 1-4, below. The '290 patent is associated with the current assignee's DURA-BRIGHT process and products.

Main Step 1. A single chemical treatment, the composition and operating parameters of which are adjusted depending on whether the preferred products to be treated are made from an Al—Mg, Al—Mg—Si or an Al—Si—Mg alloy. This chemical treatment step imparts brightness to the aluminum being treated while yielding a chemically clean outer surface ready for subsequent processing. This step replaces previous multi-step buffing and chemical cleaning operations. On a preferred basis, this chemical brightening step uses an electrolyte with a nitric acid content between about 0.05 to 2.7% by weight. It has been observed that beyond 2.7 wt % nitric acid, a desired level of brightness for Al—Mg—Si—Cu alloys cannot be achieved. On a preferred basis, the electrolyte for this step is phosphoric acid-based, alone or in combination with some sulfuric acid added thereto, and a balance of water. Preferred chemical brightening conditions for this step are phosphoric acid-based with a specific gravity of at least about 1.65, when measured at 80° F. More preferably, specific gravities for this first main method step should range between about 1.69 and 1.73 at the aforesaid temperature. The nitric acid additive for such chemical brightening should be adjusted to minimize a dissolution of constituent and dispersoid phases on certain Al—Mg—Si—Cu alloy products. Such nitric acid concentrations dictate the uniformity of localized chemical attacks between $Mg_2Si$ and matrix phases on these 6000 Series Al alloys. As a result, end product brightness is positively affected in both the process electrolyte as well as during transfer from process electrolyte to the first rinsing substep. On a preferred basis, the nitric acid concentrations of main method step 1 should be about 2.7 wt. % or less, with more preferred additions of $HNO_3$ to that bath ranging between about 1.2 and 2.2 wt. %.

Main Step 2. The second main step is to deoxidize the surface layer of said aluminum product by exposure to a bath containing nitric acid, preferably in a 1:1 dilution from concentrated. This necessary step 'prep's' the surface for the oxide modification and siloxane coating steps that follow.

Main Step 3. The third main step of this invention is a surface oxide modification designed to induce porosity in the surface's outer oxide film layer. The chemical and physical properties resulting from this modification will have no detrimental effect on end product (or substrate) brightness. Like main step 1, the particulars of this oxide modification step can be chemically adjusted for Al—Mg—Si versus Al—Si—Mg alloys using an oxidizing environment induced by gas or liquid in conjunction with an electromotive potential. Surface chemistry and topography of this oxide film are critical to maintaining image clarity and adhesion of a subsequently applied polymeric coating. One preferred surface chemistry for this step consists of a mixture of aluminum oxide and aluminum phosphate with cross-linked pore depths ranging from about 0.1 to 0.1 micrometers, more preferably less than about 0.05 micrometers. That is, subsequent to deoxidation, an oxide modification step is performed that is intended to produce an aluminum phosphate-film with the morphological and chemical characteristics necessary to accept bonding with an inorganic polymeric silicate coating. This oxide modification step should deposit a thickness coating of about 1000 angstroms or less, more preferably between about 75 and 200 angstroms thick. If applied electrochemically, this can be carried out in a bath containing about 2 to 15% by volume phosphoric acid.

Main Step 4. Fourthly, an abrasion resistant, siloxane-based layer is applied to the aluminum product, said layer reacting with the underlying porous oxide film, from above step 3, to form a chemically and physically stable bond therewith. Preferably, this siloxane coating is sprayed onto the substrate using conventional techniques in which air content of the sprayed mixture is minimized (or kept close to zero). To optimize transfer onto the aluminum part viscosity and volatility of this applied liquid coating may be adjusted with minor amounts of butanol being added thereto. That is, siloxane-based chemistries are applied to the oxide-modified layers from Main Step 3, above. Both initial and long term durability of such treated products depend on the proper surface activation of these metals, followed by a siloxane-based polymerization. Abrasion resistance of the resultant product is determined by the relative degree of crosslinking for the siloxane chemicals being used, i.e. the higher their crosslinking abilities, the lower the resultant film flexibility will be. On the other hand, lower levels of siloxane crosslinking will increase the availability of functional groups to bond with modified, underlying Al surfaces thereby enhancing the initial adhesion strengths. Under the latter conditions, however, coating thicknesses will increase and abrasion resistance decreases leading to lower clarity and durability properties, respectively. Suitable siloxane compositions for use in main step 4 include those sold commercially by SDC Coatings Inc. under their Silvue® brand. Other suitable manufacturers of siloxane coatings include Ameron International Inc., and PPG Industries, Inc. It is preferred that such product polymerizations occur at ambient pressure for minimalizing the impact, if any, to metal surface microstructure. For any given aluminum alloy composition and product form, the compatibility of main step 3 surface treatments with main step 4 siloxane polymerizations will dictate final performance attributes. Due to the stringent surface property requirements needed to achieve highly crosslinked siloxane chemical adhesion atop metal surfaces, highly controlled surface preparations and polymerization under vacuum conditions are typically used. Most preferably, siloxane chemistries are applied using finely dispersed droplets rather than ionization in a vacuum. Control and dispersion of these droplets via an airless spray atomization minimizes exposure with air from conventional paint spraying methods and achieves a preferred breakdown of siloxane dispersions in the solvent. The end result is a thin, highly transparent, "orange peel"-free durable coating.

After steps 1-4, above, were properly performed, the color and gloss of the coated surfaces were tested. Color was tested per ASTM E1164/E308 and using a hand-held BYK-Gardner Spectro Guide 45/0 Spectrophotometer (or equivalent). The BYK Color Calibration Standard is number 1083053 (L*=94.89). Gloss is tested per ASTM D4039/D523 and using a hand-held gloss meter Elcometer 406L (or equivalent). The BYK Gloss Standard is number 10071035 (93.5). The results are provided below (average of three measurements).

TABLE 5

Surface Appearance Results

| Alloy | Color (L*) | Gloss |
|---|---|---|
| 2 | 27.3 | 727 |
| 4 | 34 | 640 |

As shown, new alloy 2 outperforms alloy 4 in terms of both color and gloss quality, realizing a color (L*) value of well under the maximum limit of 40, and also realizing a gloss value of 727, well above the minimum limit of 550.

The surface hardness of coated alloy wheel 2 was also tested in accordance with ASTM D3363. Alloy 2 realized a pencil hardness rating of 9H, which is the highest possible rating under the ASTM standard.

The thermal stability of the coated wheel made from alloy 2 was also tested in accordance with GM standard GM9525P (1988). The wheel passed the test, realizing no peeling of the coated surface.

While the above appearance properties were achieved using a phosphoric acid anodizing, it is believed that similar appearance properties may be realized using other anodizing solutions (e.g., using sulfuric, chromic, or other conventionally known anodizing acids/solutions) and/or anodizing processes (e.g., conventional Type II or Type II anodizing). Further, while siloxane based coatings are noted as being used above, it is believed similar properties may be realized with other silicon-based coatings or even non-silicon based coatings. Further, while the example wheel products were in both the T5 and T10 condition (because some portions were cold worked whereas others were not), it is believed similar properties may be realized by wheel products in the T6 temper, such as when the wheel is forged and then spun prior to solution heat treatment, after which the spun wheel product is then subject to a conventional solution heat and quench, following by artificial aging.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. An aluminum alloy comprising:
from 2.5 to 4.0 wt. % Mg;
from 2.25 to 4.0 wt. % Zn;
wherein (wt. % Mg/wt. % Zn)≥1.0; and
wherein (wt. % Mg/wt. % Zn)≤1.6; and
from 0.20 to 0.9 wt. % Mn;
from 0.10 to 0.40 wt. % Cu;
up to 1.0 wt. % Li;
up to 0.50 wt. % Fe;
up to 0.50 wt. % Si;
optionally at least one secondary element selected from the group consisting of Zr, Sc, Cr, Hf, V, Ti, and rare earth elements, and in the following amounts:
up to 0.20 wt. % Zr;
up to 0.30 wt. % Sc;
up to 0.50 wt. % Cr;
up to 0.25 wt. % each of any of Hf, V, and rare earth elements;
up to 0.15 wt. % Ti;
the balance being aluminum, optional incidental elements and impurities,
wherein the aluminum alloy comprises an anodized portion and a coated portion on the anodized portion, and wherein the coated portion of the aluminum alloy realizes an L* color value of not greater than 40 L* when measured in accordance with ASTM E1164/E308, using a BYK Color Calibration Standard number of 1083053 (L*=94.89), and using a hand-held BYK-Gardner Spectro Guide 45/0 Spectrophotometer (or equivalent), and using an average of at least three L* measurements.

2. The aluminum alloy product of claim 1, wherein the aluminum alloy comprises less than 0.01 wt. % Li.

3. The aluminum alloy of claim 2, wherein the aluminum alloy comprises at least 0.01 wt. % Fe and at least 0.01 wt. % Si.

4. The aluminum alloy of claim 3, wherein the aluminum alloy comprises from 0.15-0.30 wt. % Cu.

5. A wrought product made from the aluminum alloy of claim 3, wherein the wrought product realizes a tensile yield strength of at least 32 ksi.

6. The wrought product of claim 5, wherein the wrought product realizes an elongation of at least 10%.

7. The wrought product of claim 5, wherein the wrought product realizes a rotating beam fatigue life of at least 1,000,000 cycles when tested in accordance with ISO1143, where the test specimen is unnotched ($K_t$=1), and where the test conditions are R=−1 and the stress is alternating with a maximum of 25 ksi.

8. The wrought product of claim 5, wherein the wrought product realizes an average depth of attack of not greater than 100 micrometers when tested in accordance with ASTM G110, where the depth of attack is measured after 24 hours of immersion and at the 3T/4 location of the product.

9. The aluminum alloy of claim 1, wherein the coated portion realizes a gloss value of at least 550 when measured in accordance with ASTM D4039/D523 and using a hand-held gloss meter Elcometer 406L (or equivalent), using a BYK Gloss Standard number of 10071035 (93.5), and using an average of at least three gloss value measurements.

10. The aluminum alloy of claim 1, wherein the coated portion realizes a surface hardness value of at least 7H when tested in accordance with ASTM D3363.

11. The aluminum alloy of claim 1, wherein the coated portion is thermally stable as per GM standard GM9525P (1988).

12. The aluminum alloy of claim 1, wherein the coated portion comprises a silicon-based coating.

13. The aluminum alloy wrought product of claim 12, wherein the silicon-based coating is a siloxane based coating.

* * * * *